US008128082B2

(12) United States Patent
Ikeuchi et al.

(10) Patent No.: US 8,128,082 B2
(45) Date of Patent: Mar. 6, 2012

(54) SHEET FEEDING DEVICE AND IMAGE FORMING APPARATUS WITH LIFTING AND AIR BLOWING UNITS

(75) Inventors: Hiroyuki Ikeuchi, Kanagawa (JP); Takuo Matsumura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 46 days.

(21) Appl. No.: 12/559,066

(22) Filed: Sep. 14, 2009

(65) Prior Publication Data

US 2010/0104337 A1 Apr. 29, 2010

(30) Foreign Application Priority Data

Oct. 17, 2008 (JP) ..... P2008-268921

(51) Int. Cl.
*B65H 1/08* (2006.01)

(52) U.S. Cl. ..... 271/30.1; 271/97; 271/31

(58) Field of Classification Search ..... 271/97, 271/30.1, 31
See application file for complete search history.

(56) References Cited

U.S. PATENT DOCUMENTS

| | | | | |
|---|---|---|---|---|
| 8,011,652 | B2 * | 9/2011 | Tsukamoto et al. | 271/97 |
| 2005/0285326 | A1 * | 12/2005 | Uji et al. | 271/97 |
| 2008/0290589 | A1 * | 11/2008 | Uji et al. | 271/153 |

FOREIGN PATENT DOCUMENTS

| | | | | |
|---|---|---|---|---|
| JP | 04-023747 | | | 1/1992 |
| JP | 2003-063675 | A | | 3/2003 |
| JP | 2005104723 | A | * | 4/2005 |
| JP | 2006-008352 | A | | 1/2006 |
| JP | 2006008352 | A | * | 1/2006 |
| JP | 2006256820 | A | * | 9/2006 |

* cited by examiner

*Primary Examiner* — Gerald McClain
(74) *Attorney, Agent, or Firm* — Morgan, Lewis & Bockius LLP

(57) ABSTRACT

A sheet feeding device includes a sheet storing unit in which sheets are stacked; a lifting unit that lifts and lowers the sheets; an air blowing unit that blows air to an end faces of the stacked sheets; a feeding roller that is pressed against an upper surface of an uppermost sheet of the sheets and feeds the uppermost sheet by rotating; and a supplying roller that supplies the uppermost sheet, wherein the lifting unit is driven so that height of the uppermost sheet, which is fed by the feeding roller while air is blown by the air blowing unit, is set to be lower than height of the uppermost sheet, which is fed by the feeding roller while air is not blown by the air blowing unit.

3 Claims, 7 Drawing Sheets

SHEET FEEDING DEVICE AND IMAGE FORMING APPARATUS WITH LIFTING AND AIR BLOWING UNITS

CROSS-REFERENCE TO RELATED APPLICATION

This application is based on and claims priority under 35 USC 119 from Japanese Patent Application No. 2008-268921 filed on Oct. 17, 2008.

BACKGROUND

1. Technical Field

The present invention relates to a sheet feeding device and an image forming apparatus using the sheet feeding device.

2. Related Art

A sheet feeding device is used in an image forming apparatus, such as a printer or a copier. The sheet feeding device sequentially feeds recording sheets, which are cut to have a predetermined size, as recording media on which images are formed. Further, a printing machine, or the like, also uses a sheet feeding device that sequentially feeds printing sheets cut to have a predetermined size. Double-feed, where two or more recording sheets are fed while overlapping each other, occurs in the sheet feeding device.

SUMMARY

According to an aspect of the invention, a sheet feeding device includes a sheet storing unit in which sheets are stacked and stored; a lifting unit that lifts and lowers the sheets stacked in the sheet storing unit; an air blowing unit that blows air to an end faces of the stacked sheets; a feeding roller that is pressed against an upper surface of an uppermost sheet of the sheets stacked in the sheet storing unit and feeds the uppermost sheet by rotating; and a supplying roller that supplies the uppermost sheet, which is fed from the feeding roller, to a next process wherein the lifting unit is driven so that height of the uppermost sheet, which is fed by the feeding roller while air is blown by the air blowing unit, is set to be lower than height of the uppermost sheet, which is fed by the feeding roller while air is not blown by the air blowing unit.

BRIEF DESCRIPTION OF THE DRAWINGS

Exemplary embodiments of the invention will be described in detail based on the following figures, wherein.

DETAILED DESCRIPTION

An exemplary embodiment of the invention will be described below with reference to drawings.

Figure 1:
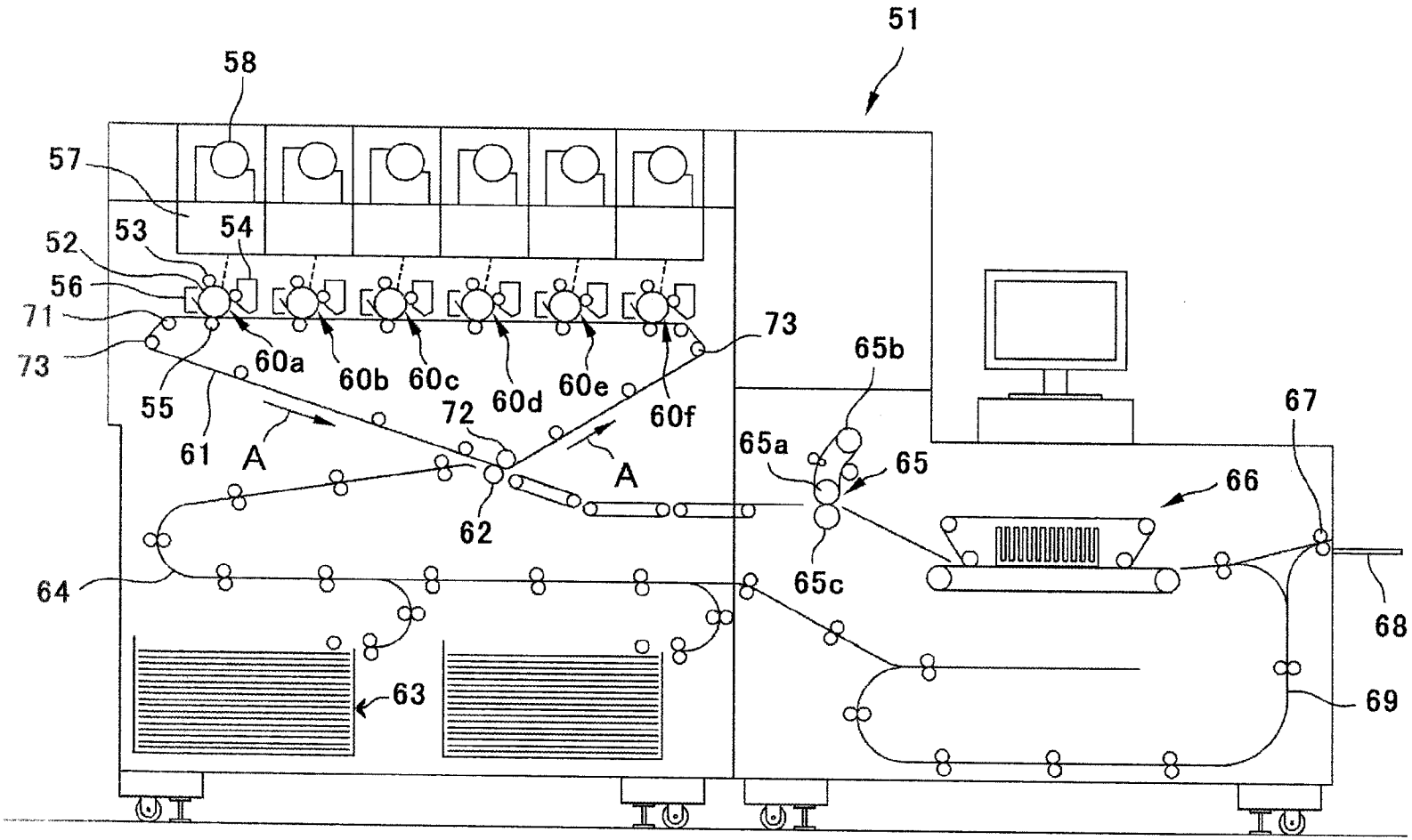
FIG. 1 is a schematic view showing the configuration of an image forming apparatus according to an exemplary embodiment of the invention.

FIG. 1 is a schematic view showing the configuration of an image forming apparatus according to an exemplary embodiment of the invention.

The image forming apparatus 51 includes six image forming units 60*a*, 60*b*, 60*c*, 60*d*, 60*e*, find 60*f* that form yellow, magenta, cyan, black, light magenta, and light cyan toner images. An endless belt-like intermediate transfer body 61 is supported so as to face all the image forming units, and is driven so that the peripheral surface of the intermediate transfer body goes around. A transfer roller 62, which is a transfer device of this exemplary embodiment, is provided downstream of the positions facing the image forming units 60*a*, 60*b*, 60*c*, 60*d*, 60*e*, and 60*f* in a moving direction of the peripheral surface of the intermediate transfer body 61, so as to face the intermediate transfer body 61. A recording sheet is fed to this secondary transfer section from sheet feeding devices 63 via a conveying path 64. A fixing device 65, which is a fixing device of this exemplary embodiment and heats and presses the toner image to attach the toner image to the recording sheet, is provided downstream of the secondary transfer section in a conveying direction of the recording sheet. A cooling device 66 is provided downstream of the fixing device so as to cool the recording sheet and the toner image fixed to the recording sheet. Plural of conveying roller pairs 67 for conveying a recording sheet and a sheet discharge tray 68 are provided downstream of the cooling device, so that a recording sheet, where the toner image is fixed, is stored in the sheet discharge tray. Further, a double-sided conveying path 69, which reverses the recording sheet and feeds the recording sheet to the secondary transfer section so that an image is formed on the back surface of the recording sheet, is provided downstream of the cooling device 66.

The image forming units 60 may form yellow, magenta, cyan, black, light magenta, and light cyan toner images, respectively. The image forming units are arranged in the image forming apparatus 51 at predetermined intervals in a horizontal direction as shown in FIG. 1, and are detachably attached to the image forming apparatus.

Each of the image forming units 60*a*, 60*b*, 60*c*, 60*d*, 60*e*, and 60*f* includes a photoreceptor drum 52. An electrostatic latent image is formed on the surface of the photoreceptor drum. Further, each of the image forming units includes a charging device 53, a developing device 54, a transfer device 55, and a cleaning device 56 that are provided around the photoreceptor drum 52. The charging device substantially uniformly charges the surface of the photoreceptor drum 52 with electricity, the developing device forms a toner image by transferring a toner to the latent image formed on the photoreceptor drum 52, the transfer device primarily transfers the toner image formed on the photoreceptor drum 52 onto the intermediate transfer body 61, and the cleaning device collects a residual toner remaining on the photoreceptor drum 52 after the transfer. Furthermore, there are provided exposure devices 57 that write electrostatic latent images on the uniformly charged photoreceptor drums 52 by irradiating the uniformly charged photoreceptor drums with image light based on image signals.

The photoreceptor drum 52 is formed by forming an organic photoreceptor layer on the peripheral surface of a cylindrical member that is made of metal. The metal portion of the photoreceptor drum is electrically grounded.

The charging device 53 includes a roller-like member that is formed by coating a cylindrical metal core, which is made of stainless steel, with rubber having a medium resistance. The charging device charges the surface of the photoreceptor drum 52 at a desired voltage by the application of a voltage where an AC component is superimposed on a DC component. The DC component Vh of the voltage, which is applied to the charging device 53, may be set to, for example, −600 [V]. The AC peak-to-peak value Vbpp, which is superimposed, may be set to, for example, 1400 [V].

The exposure device 57 generates a laser beam that flickers on the basis of the image signal, and scans the photoreceptor drum with the laser beam in a main scanning direction (axial direction) of the photoreceptor drum 52 by using a polygon mirror. Accordingly, the potential of a portion of the photoreceptor drum 52, which is irradiated with the laser beam, is reduced, and an electrostatic latent image corresponding to each color is formed on the surface of the photoreceptor drum 52 by the difference in the electrostatic potential.

A two-component developer, which includes a toner and a magnetic carrier, is used as a developer in the developing device 54. While being magnetically attracted to a developing roller, the two-component developer is conveyed. Further, the two-component developer forms a layer, which has an appropriate thickness, on the developing roller by a regulation blade, and is supplied to a position facing the photoreceptor drum 52. A developing bias voltage Vd is applied to the developing roller so that the toner is transferred onto the electrostatic latent image formed on the photoreceptor drum 52. The developing bias voltage Vd may be set to, for example, −500 [V]. Further, in the image forming apparatus 51 according to this exemplary embodiment, sub-toner storage chambers 58, which are spare storage chambers for toners supplied to the developing devices 54, are provided above the respective image forming units 60*a*, 60*b*, 60*c*, 60*d*, 60*e*, and 60*f*.

The intermediate transfer body 61 is disposed so as to face the image forming units 60*a*, 60*b*, 60*c*, 60*d*, 60*e*, and 60*f*, and is made of a synthetic resin, such as a PET or a flexible polyimide film. A driving roller 71, an opposite roller 72, and support rollers 73 are disposed inside the intermediate transfer body 61. The intermediate transfer body 61 is stretched by these rollers and goes around in a direction indicated by an arrow "A" in FIG. 1.

The transfer roller 62 is positioned at a position facing the opposite roller 72, and is pressed against the opposite roller 72 with the intermediate transfer body 61 interposed therebetween. The transfer roller 62 is formed in the shape of a roller by forming an outer peripheral portion, which is made of a conductive rubber material, on a metal core. A developing bias voltage is applied between the opposite roller 72 and the transfer roller.

The fixing device 65 includes a fixing belt 65*b* that is stretched by plural of roller-like members including a heating roller 65*a* in which a source of heat is built, and a pressure roller 65*c* that is pressed against the heating roller 65*a* with the fixing belt 65*b* interposed therebetween. A recording sheet is fed between the fixing belt 65*b* and the pressure roller 65*c* at a portion where the heating roller 65*a* and the pressure roller 65*c* are pressed against each other, and is heated and pressed, so that the toner image is fixed to the recording sheet.

An elastic layer formed of an elastic material such as a heat resistant rubber is formed on the peripheral surface of a metal core of the heating roller 65*a*, and a halogen heater is built in the heating roller as a source of heat. The pressure roller 65*c* is formed by coating the metal core with a surface release layer.

The conveying roller pair 67, which is provided downstream of the fixing device 65, is composed of a driving roller and a pinch roller that faces the surface of the recording sheet on which an image is held. The conveying roller pair is provided on both sides of the conveying path of the recording sheet, and comes in contact with each other. Each of the rollers is formed by fixing plural of cylindrical bodies, which are made of a synthetic resin and have a small width, to a metal shaft at predetermined intervals. As the driving roller is rotationally driven, the rollers convey the recording sheet coming in contact with the rollers. Further, the pinch roller is supported so as to freely rotate. Accordingly, as the driving roller is rotationally driven, the pinch roller is driven and smoothly conveys the recording sheet.

The sheet feeding device 63 will be described below.

Figure 2:
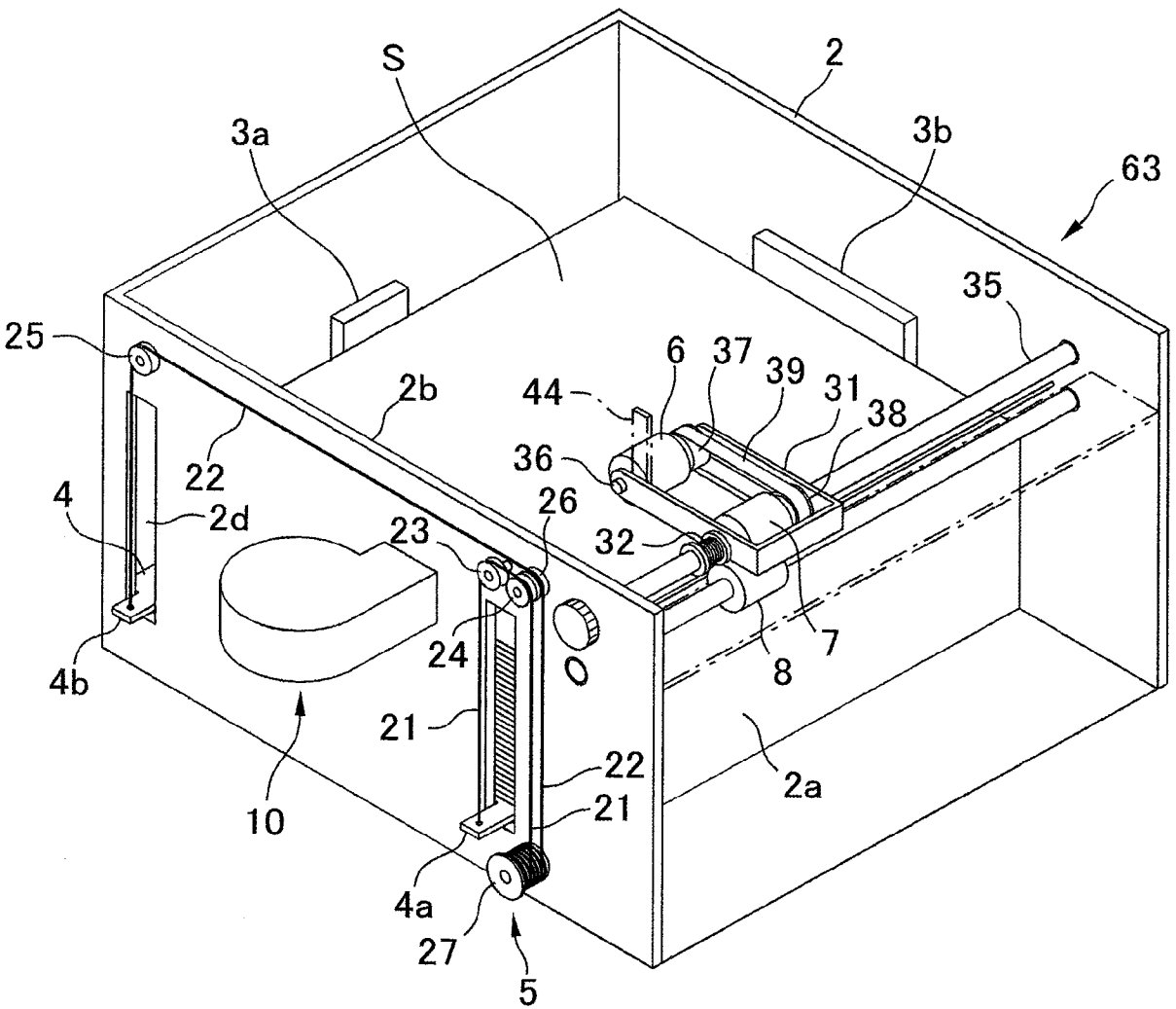
FIG. 2 is a schematic perspective view of a sheet feeding device according to an exemplary embodiment of the invention that is a sheet feeding device used for the image forming apparatus shown in FIG. 1.
Figure 3:
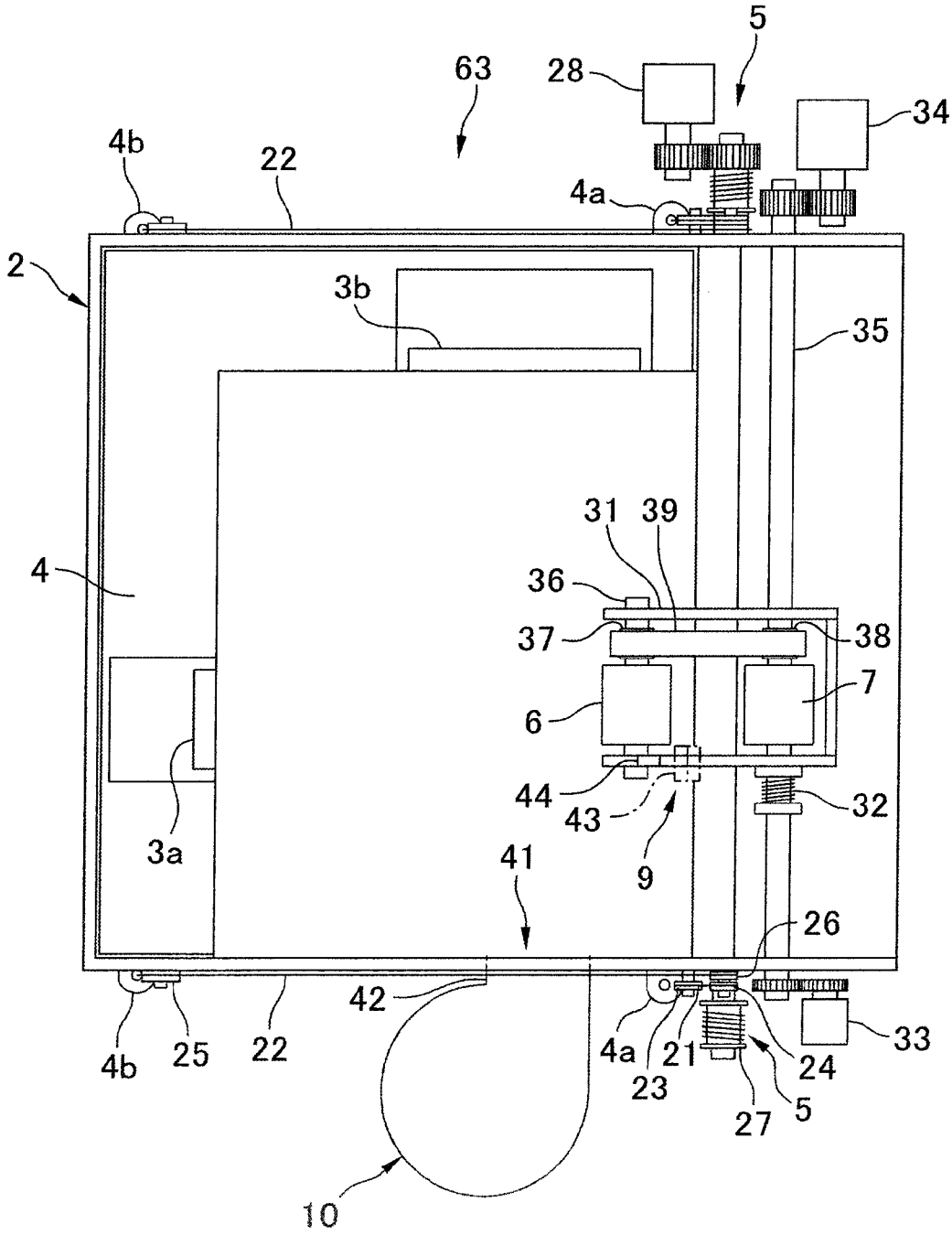
FIG. 3 is a schematic plan view of the sheet feeding device shown in FIG. 2.
Figure 4:
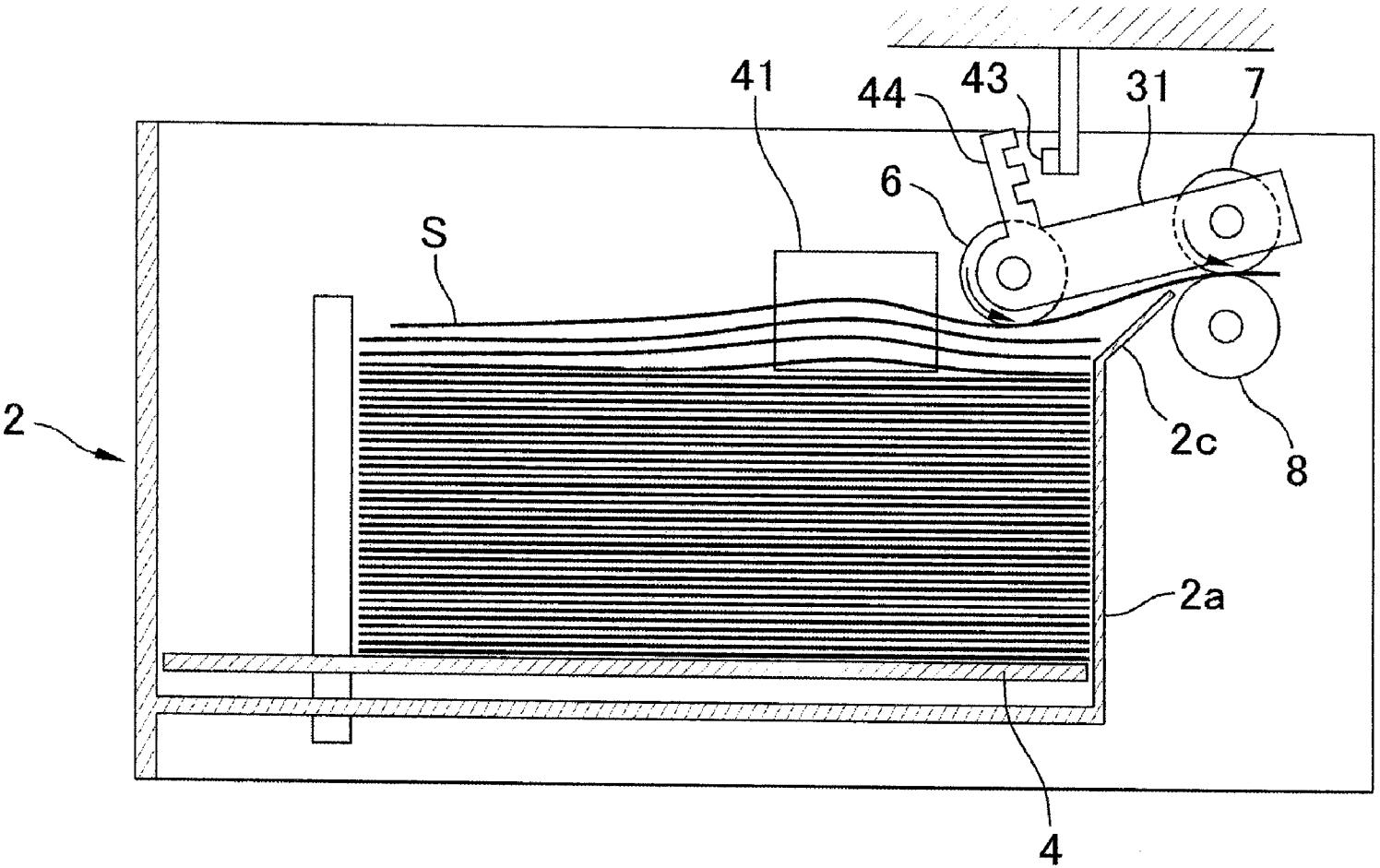
FIG. 4 is a schematic cross-sectional view of the sheet feeding device shown in FIG. 2.

FIG. 2 is a schematic perspective view of a sheet feeding device according to an exemplary embodiment of the invention, FIG. 3 is a schematic plan view of the sheet feeding device, and FIG. 4 is a schematic cross-sectional view of the sheet feeding device.

The sheet feeding device 63 mainly includes a sheet tray 2 (sheet storing unit) in which plural of sheets S is stacked and stored, sheet guides 3 that regulate the positions of the sheets in the sheet tray, a bottom plate 4 on which the stacked sheets are placed and which moves up and down to adjust the height of the uppermost sheet regardless of the amount of sheets, a lifter 5 that lifts and lowers the bottom plate 4, a feeding roller 6 that feeds the sheets from the sheet tray 2 one by one, a supplying roller 7 that conveys the sheet fed from the feeding roller 6 toward the downstream side, a separation roller 8 that is disposed to come in contact with the peripheral surface of the supplying roller 7, a sheet-upper surface detector 9 that detects the height of the uppermost sheet of the stacked sheets, and an air blower 10 that blows air to the end faces of the sheets S stacked and stored in the sheet tray.

Sheets, which are cut to have a predetermined size, are stacked and stored in the sheet tray 2. The sheets S, which are stacked in the sheet tray, are stored so that the side edges of the sheets face the front and side walls 2*a* and 2*b* of the sheet tray in a feeding direction. The side wall 2*b* functions as a side reference position (so-called side registration), and the sheets S are fed along the side wall. Further, the sheet guides 3*a* and 3*b* are movably provided at positions facing the walls 2*a* and 2*b*. The positions of the sheets having different sizes are regulated by adjusting the positions of the sheet guides 3*a* and 3*b*, and the sheets are stored so that the end faces of the stacked sheets S face the front and side walls 2*a* and 2*b*.

An upper portion 2*c* of the wall 2*a*, which is provided on the front side in the feeding direction where the sheets of the sheet tray 2 are fed, forms an inclined surface that is inclined upward toward the feeding direction of the sheet. Accordingly, even though being fed from a position below the top portion of the front wall, the sheet to be fed from the sheet tray 2 may be moved up along the inclined surface and fed to a contact portion between the supplying roller 7 and the separation roller 8 that are provided on the front side.

Meanwhile, in addition to plain paper, a sheet having high surface smoothness such as a coated paper of which the surface is coated to be glossy may be used as the sheet.

The bottom plate 4 is provided at the bottom of the sheet tray 2, and the sheets S to be stored in the sheet tray are stacked on the bottom plate. Front supports 4*a* and rear supports 4*b* are provided on both sides of the bottom plate 4 so as to protrude outward, and protrude from vertically long openings 2*d* that are formed at the wall 2*b*. The supports 4*a* and 4*b* are supported by the lifter 5 that is provided on the outer surfaces of the walls. As the lifter 5 is driven, the stacked sheets S are lifted while being maintained substantially horizontal.

Figure 5:
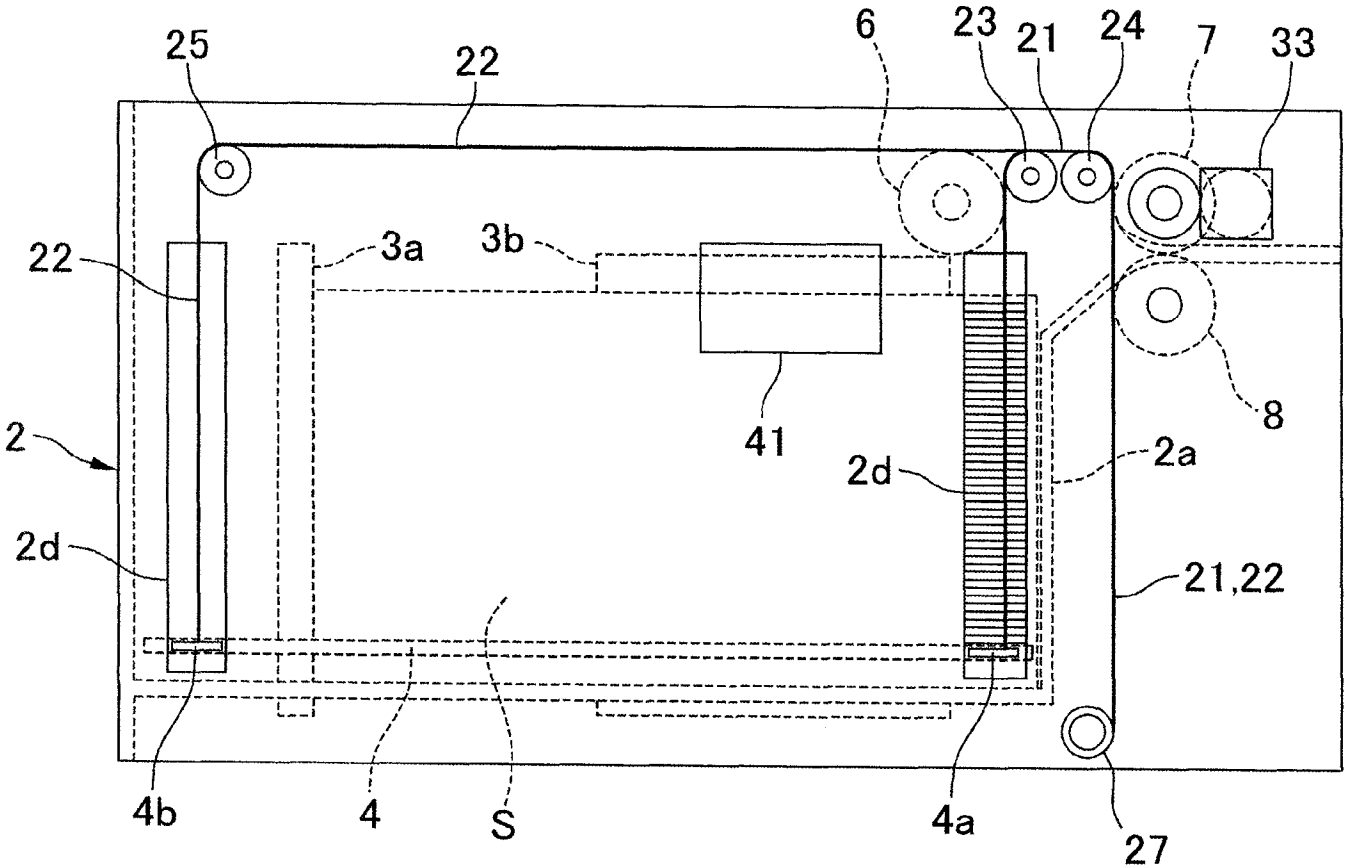
FIG. 5 is a schematic side view of the sheet feeding device shown in FIG. 2.

As shown in FIGS. 2, 3, and 5, the lifter 5 includes lift-up wires 21 and 22 that are fixed to the plural supports 4*a* and 4*b* formed at the bottom plate 4, pulleys 23, and 24 on which the lift-up wires 21 are wound, pulleys 25, and 26 on which the lift-up wires 22 are wound, winding rollers 27 that wind the lift-up wires 21 and 22, and a drive unit 28 that drives the winding rollers 27.

The lift-up wire 21, which is fixed to the front support 4*a* of the bottom plate 4, is wound on the first pulley 23, which is provided above the front support 4*a*, and then wound on the winding roller 27 via the second pulley 24. The lift-up wire 22, which is fixed to the rear support 4*b*, is wound on the third pulley 25 and then wound on the winding roller 27 via the fourth pulley 26. Accordingly, when the lift-up wires 21 and 22 are wound, the bottom plate 4 is lifted while being maintained substantially horizontal, and the sheets S stacked on the bottom plate are also lifted. Meanwhile, when the winding roller 27 is rotationally driven in a reverse direction, the bottom plate 4 is lowered while being maintained horizontal, and the sheets S are also lowered.

The upper surface of the sheets S stacked on the bottom plate 4 is controlled to reach a predetermined height by the lifter 5. The position of the upper surface of the stacked sheets S is set to be different between when air is blown to the end edges of the stacked sheets S by the air blower 10 and the sheet is fed and when air is not blown to the stacked sheets and the sheet is fed. When air is blown by the air blower 10, the height of the upper surface of the sheet is set to a low position as compared to when air is not blown.

The feeding roller 6 comes in contact with the upper surface of the stacked sheets S, is rotated, and feeds the uppermost sheet by a frictional force of the peripheral surface thereof. As shown in FIG. 2, the feeding roller is supported by a frame 31 that may be swung up and down. Further, the frame 31 is pushed by a spring 32 so as to press the sheets S that are stored in the sheet tray 2, and is driven by a drive unit 33 so that the feeding roller 6 is withdrawn from the sheet against the pushing force.

The supplying roller 7 is fixedly provided downstream of the feeding roller 6, and is rotationally driven by a drive motor 34. When being rotationally driven, the supplying roller 7 may convey a sheet interposed between the separation roller 8 and the supplying roller and convey the sheet toward a position where an image is formed on the sheet.

Pulleys 37 and 38 are provided on a support shaft 35 of the supplying roller 7 and a support shaft 36 of the feeding roller 6, respectively. The drive torque of the supplying roller 7 is transmitted to the feeding roller 6 by a belt 39 that is wound around the pulleys 37 and 38, so that the feeding roller 6 is driven.

The separation roller 8 is disposed to come in contact with the peripheral surface of the supplying roller 7, and is driven in a feeding direction of the sheet and a reverse direction through a torque limiter (not shown). Accordingly, if two or more sheets, which are fed from the feeding roller 6, overlap each other at the contact portion between the supplying roller 7 and the separation roller 8, the sheets are separated and return to the shed tray 2 one by one. That is, if plural of sheets enters the contact portion between the supplying roller 7 and the separation roller 8 while overlapping each other, a drive force of the supplying roller 7 is transmitted to the uppermost sheet, so that slippage occurs between the uppermost sheet and the second or later sheets. As a result, the first sheet is separated from the second or later sheets. Further, the first sheet is conveyed downstream, and the second or later sheets are conveyed to return to the sheet tray 2 by the drive torque of the separation roller 8. Meanwhile, if one sheet is fed between the supplying roller 7 and the separation roller 8, the separation roller 8 is driven by the operation of the torque limiter so as to follow the supplying roller 7 and the sheet is conveyed downstream.

Meanwhile, the separation roller 8 is not limited to an example that uses a torque limiter as described above, and a roller where resistance is imparted to rotation may be used as the separation roller. Further, a pad, which is to be pressed against the supplying roller, may be used instead of the separation roller 8.

The air blower 10 assists a double-feed preventing mechanism that includes the supplying roller 7 and the separation roller 8. The air blower mainly includes an air outlet 41 that is formed at the side wall 2*b* of the sheet tray 2, a duct 42 that communicates with the air outlet 41, and a fan (not shown) that sends air to the duct 42. Further, the air blower blows air from the side above the end faces of the stacked sheets S and the upper surface of the stacked sheets.

When air is blown to the end faces of the stacked sheets S as described above, negative pressure is generated by an air current generated above the sheets S, so that the uppermost sheet S floats. Accordingly, air flows below the uppermost sheet, so that the sheet S under the uppermost sheet also floats. These operations sequentially occur, so that the sheets S are separated one by one and adhesion between the sheets S is decreased.

The air blower 10 may be controlled in a mode where air is blown and a mode where air is not blown, when a sheet is fed, in accordance with an operator's selection or the type of a sheet to be used.

As shown in FIG. 4, the sheet-upper surface detector 9 includes a sensor 43 and a detected body 44. The sensor is fixed to the sheet tray 2 or a body of an image forming apparatus, a printer, or the like, where the sheet feeding device 63 is used. The detected body is mounted on the frame 31 that supports the feeding roller 6. As long as the height of the detected body may be detected when the detected body 44 is positioned at a predetermined height, any sensor may be used as the sensor 43. For example, a sensor that includes a light-emitting element and a light-receiving element and detects the reflected light of light emitted from the light-emitting element, or a sensor for detecting that light emitted from a light-emitting element toward a light-receiving element is shielded may be used as the sensor.

The sensor 43 detects the detection reference position of the detected body 44 when the feeding roller 6 comes in contact with the upper surface of the stacked sheets and reaches a predetermined height with the bottom plate 4 being lifted. Two detection reference positions are set in the detected body 44. A first detection reference position 44*a* is a position to be detected when a contact surface between the feeding roller 6 and the sheet S reaches a feeding position where the sheet is fed while air is blown by the air blower 10. Further, a second detection reference position 44*b* provided below the first detection reference position 44*a* is a position to be detected when a contact surface between the feeding roller 6 and the sheet S reaches a feeding position where the sheet is fed while air is not blown by the air blower 10. Accordingly, the feeding position where the sheet is fed while air is blown by the air blower 10 is set to be lower than the feeding position while air is not blown by the air blower 10.

The operation of the sheet feeding device will be described below.

Figure 6A:
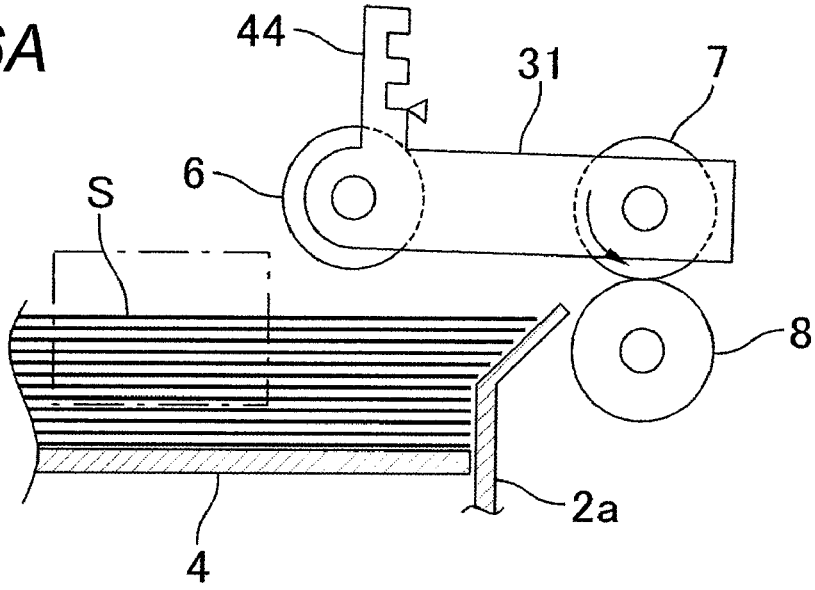
FIGS. 6A and 6B are a partial cross-sectional view showing that the height of a sheet is set and a sheet is fed in the sheet feeding device shown in FIG. 2 while air is not blown.
Figure 6B:
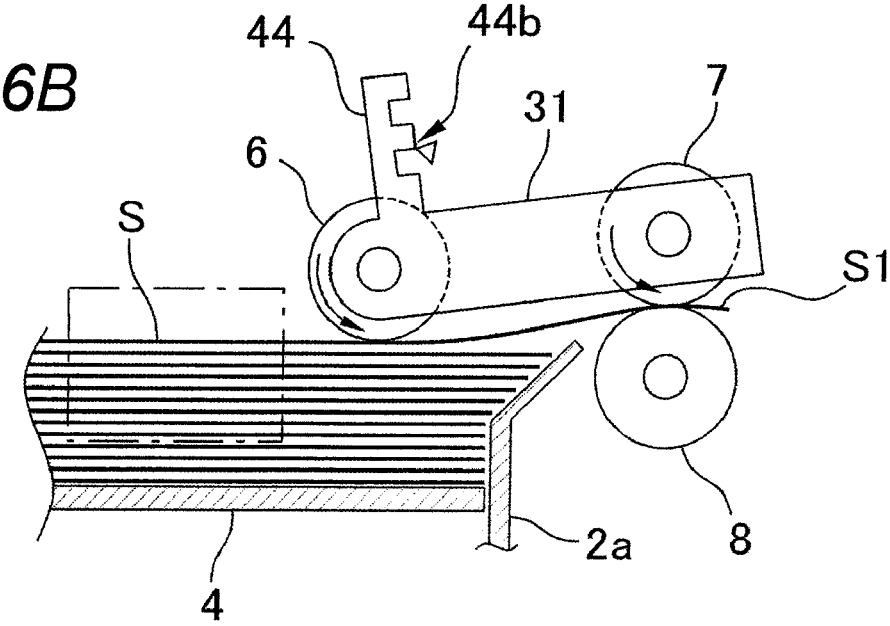

When a sheet is set to be fed while air is not blown to the sheets S, the bottom plate 4 is gradually lifted from the lowest position or after being lowered to a low position as shown in FIG. 6A. Further, the feeding roller 6 is lowered by the pushing force of the spring, and comes in contact with the upper surface of the sheets S that are stacked on the bottom plate 4. Furthermore, the bottom plate 4 is lifted so as to push up the feeding roller 6. The bottom plate 4 is stopped when the sensor 43 detects the second detection reference position 44*b* as shown in FIG. 6B. In this case, the contact surface between the feeding roller 6 and the sheet S is set to a height of the position where a sheet is fed while air is not blown, and the position in the height direction corresponds to a height close to a position where the supplying roller 7 and the separation roller 8 come in contact with each other. Then, the feeding roller 6 begins to be rotationally driven, so that the uppermost sheet S1 is fed from the sheet tray 2 and fed between the supplying roller 7 and the separation roller 8 as shown in FIG. 6B. If two or more overlapping sheets are fed, the second or later sheets are separated by the separation roller 8 and the uppermost sheet is conveyed.

Figure 7A:
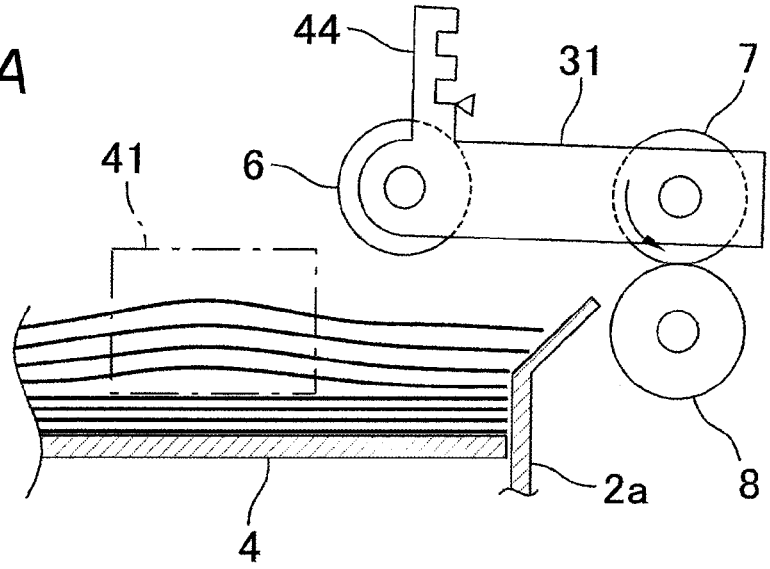
FIGS. 7A and 7B are a partial cross-sectional view showing that the height of a sheet is set and a sheet is fed in the sheet feeding device shown in FIG. 2 while air is blown.
Figure 7B:
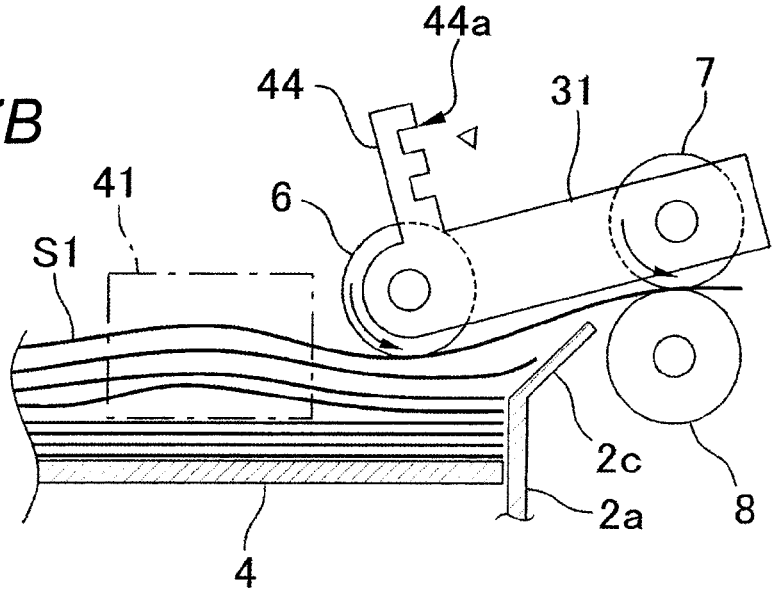

Meanwhile, when a sheet is set to be fed while air is blown to the sheets S, the bottom plate 4 is lifted from a low position as shown in FIG. 7A and air begins to be blown from the air blower 10 to the end faces of the stacked sheets S stacked on the bottom plate 4 to be being lifted. Further, the feeding roller 6 is lowered by the pushing force of the spring, and comes in contact with the upper surface of the sheet that floats by air blowing. Furthermore, the bottom plate 4 is lifted so as to push the feeding roller 6 upward. The bottom plate 4 is stopped when the sensor detects the first detection reference position 44*a* as shown In FIG. 7B. In this case, the feeding roller 6 is set to a height of the position where a sheet is fed while air is blown, and this height corresponds to a low position as compared to when the sheet is fed while air is not blown.

If the feeding roller 6 begins to be rotationally driven and the uppermost sheet S1 is thus fed at this height, the sheet S1 is bent upward by the front wall 2*a* of the sheet tray 2. In this case, since being bent upward, the portion 2*c* of the first wall, which is inclined toward the conveying direction of the sheet, comes in contact with the lower surface of the sheet. Accordingly, the inclined portion 2*c* functions as a resistance imparting member for imparting resistance to the conveyance of the second or later sheets that are positioned below the uppermost sheet. The inclined portion suppresses that the second or later sheets are fed between the supplying roller 7 and the separation roller 8 while overlapping each other.

The detection of the upper surface of the stacked sheet during the air blowing is performed while air is blown. Accordingly, it may be possible to accurately detect the height of the position where a sheet is actually fed. That is, the upper sheets of the stacked sheets float by air blowing, so that the height of the uppermost sheet is increased as compared to before the air blowing. Further, while floating, the uppermost sheet is fed. Accordingly the position of the uppermost sheet, which is detected while the uppermost sheet floats, is close to the height of the sheet that is to be actually fed.

Further, while the upper sheets float, the feeding roller 6 comes in contact with the uppermost sheet and the position of the uppermost sheet is detected. Accordingly, it may be possible to more accurately set a feeding position. If the feeding roller 6 comes in contact with the floating sheet, the floating sheet is pushed down by the contact pressure of the feeding roller. Since the uppermost sheet S1 is fed while coming in contact with the feeding roller 6, the position of the uppermost sheet detected while the feeding roller 6 comes in contact with the uppermost sheet is closer to the height of the sheet that is to be actually fed.

If sheets, of which the stacked sheets are easily separated from each other, are used in the sheet feeding device 63, double-feed hardly occurs and sheets are smoothly fed even though a sheet is fed between the supplying roller 7 and the separation roller 8 while air is not blown from the air blower 10. Further, if sheets, which have high adhesion between stacked sheets and are apt to cause double-feed, are used, the sheets are separated from each other by making the stacked sheets float by air blowing. Further, if the sheets float and resistance is thus reduced during the conveyance of the sheets, the second or later sheets are also apt to enter between the supplying roller 7 and the separation roller 8 together with the uppermost sheet. However, since the height of the position where a sheet is fed is changed, resistance is imparted to the second or later sheets. Accordingly, a sheet is fed while floating, so that double-feed is prevented.

The sheet tray 2 has been employed as a sheet storing unit in the above-mentioned exemplary embodiment. However, as long as stacked sheets are stored, it may be possible to employ any units having various forms and shapes. Further, it may be possible to employ units that are detachably attached to the body of the image forming apparatus and the like, units that are built in the body of an apparatus not to be detached, or the like.

The lifter that pulls the bottom plate by wires has been employed as a lifting unit in this exemplary embodiment. How ever, as long as the position of the upper surface of the uppermost sheet may be adjusted by lifting and lowering the stacked sheets, it may be possible to employ any units having various structures. For example it may be possible to employ a unit that pushes up the bottom plate by arms or link mechanisms, or a unit that uses a pushing force of a spring.

As long as air is blown to the end edges of the stacked sheets, any units having various forms may be used as the air blower 10. In addition to the air blowing, a shutter may be provided at the air outlet 41 in order to change the speed and blowing range of the air blown from the air outlet 41, so that it may also be possible to apply wind pressure in order to separate the stacked sheets. In addition, it may be possible to facilitate drying through the air blowing by heating air, which flows from an air intake, by a heater. Since the sheet S is dried, adhesion between the sheets is decreased, so that double-feed is effectively prevented.

Further, the upper portion 2*c* of the wall, which is provided on the front side of the sheet tray, has been used as a resistance imparting member in this exemplary embodiment. However, a resistance imparting member, which guides a sheet and imparts resistance to a sheet, may be separately provided. For example, a material having a larger frictional force may be attached to the upper portion 2*c* of the wall. Further, it may be possible to appropriately design the shape, or the like.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A sheet feeding device comprising:

a sheet storing unit in which sheets are stacked and stored;

a lifting unit that lifts and lowers the sheets stacked in the sheet storing unit;

an air blowing unit that blows air to end faces of the stacked sheets;

a feeding roller that is pressed against an upper surface of a first sheet and feeds the first sheet by rotating, the first sheet being an uppermost sheet of the sheets stacked in the sheet storing unit; and a supplying roller that transports the first sheet, which is fed from the feeding roller, wherein the lifting unit is driven so that the height of the first sheet, which is fed by the feeding roller while air is blown by the air blowing unit, is set to be lower than the height of the first sheet, which is fed by the feeding roller while air is not blown by the air blowing unit, and a detecting unit that detects a position of an upper surface of the stacked first sheet, wherein a driving control of the lifting unit, when the sheets are fed while air is blown, is performed based on detection result of the position of the upper surface of the first sheet, the detection result being obtained while air is blown to the stacked sheets, wherein the detecting unit detects the position of the upper surface of the stacked first sheet by referring a position of the feeding roller, which is pressed against the sheets floating because of air blowing, in a vertical direction.

2. The sheet feeding device according to claim 1, further comprising:

a resistance imparting member that comes in contact with a second sheet and imparts resistance to a conveyance of the second sheet when the first sheet and the second sheet are fed to overlap each other, the second sheet being bellow the first sheet stacked in the sheet storing unit.

3. An image forming apparatus comprising:

an image forming unit that forms toner images by attaching a toner to latent images formed by a difference in an electrostatic potential;

a sheet feeding device that supplies a recording sheet, onto which the toner image is transferred, to the image forming units;

a transfer device that directly transfers the toner images onto the recording sheet , or transfer the toner images, after transferring the toner images onto an intermediate transfer body, onto the recording sheet; and a fixing device that fixes the toner images to the recording sheet by heating the toner images transferred onto the recording sheet, wherein the sheet feeding device includes :

a sheet storing unit in which sheets are stacked and stored;

a lifting unit that lifts and lowers the sheets stacked in the sheet storing unit;

an air blowing unit that blows air to end faces of the stacked sheets;

a feeding roller that is pressed against an upper surface of an uppermost sheet of the sheets stacked in the sheet storing unit and feeds the uppermost sheet by rotating; and a supplying roller that transports the uppermost sheet, which is fed from the feeding roller, wherein the lifting unit is driven so that the height of the uppermost sheet, which is fed by the feeding roller while air is blown by the air blowing unit, is set to be lower than the height of the uppermost sheet, which is fed by the feeding roller while air is not blown by the air blowing unit, and a detecting unit that detects a position of an upper surface of the stacked first sheet, wherein a driving control of the lifting unit, when the sheets are fed while air is blown, is performed based on detection result of the position of the upper surface of the first sheet, the detection result being obtained while air is blown to the stacked sheets, wherein the detecting unit detects the position of the upper surface of the stacked first sheet by referring a position of the feeding roller, which is pressed against the sheets floating because of air blowing, in a vertical direction.

* * * * *